United States Patent [19]

Rowley, II

[11] 4,206,939

[45] Jun. 10, 1980

[54] LATCH ASSEMBLY FOR VENT WINDOWS AND THE LIKE

[75] Inventor: Stephen K. Rowley, II, Taylor, Mich.

[73] Assignee: Ford Motor Company, Dearborn, Mich.

[21] Appl. No.: 960,154

[22] Filed: Nov. 13, 1978

[51] Int. Cl.[2] ..... E05C 17/10

[52] U.S. Cl. ..... 292/263

[58] Field of Search ..... 292/113, 210, 247, 263, 292/DIG. 42, DIG. 49, DIG. 5

[56] References Cited

U.S. PATENT DOCUMENTS

| | | | |
|---|---|---|---|
| 2,239,327 | 4/1941 | Holby | 292/210 X |
| 2,475,131 | 7/1949 | Edwards et al. | 292/263 |
| 3,400,963 | 9/1968 | Jablonski | 292/247 |
| 3,534,992 | 10/1970 | Swanson | 292/113 |
| 3,602,723 | 8/1971 | Swanson | 292/113 |
| 3,711,893 | 1/1973 | King | 16/128 |
| 3,933,406 | 1/1976 | Cameron et al. | 339/91 R |
| 3,936,082 | 2/1976 | Swanson | 292/113 |
| 4,067,605 | 1/1978 | Green et al. | 292/263 |

FOREIGN PATENT DOCUMENTS 1070044 11/1959 Fed. Rep. of Germany .

*Primary Examiner*—Richard E. Moore

*Attorney, Agent, or Firm*—Steven L. Permut; Keith L. Zerschling

[57] ABSTRACT

A toggle catch for an automobile vent window and the like with a base, handle and an intermediate link pivotably connected to the base and handle. The handle has a pair of opposed spring biased latches which engage opposed flanges of a base portion of the toggle catch. The latches are manually operable to a disengaging position to allow the toggle catch to move to an open position. Upon closure of the toggle catch, the latches have prongs with camming surfaces which automatically bias the latch over the flanges until the prongs are under the flange and allowed to spring back to the engaged position to automatically lock the toggle catch in a closed and locked position.

6 Claims, 9 Drawing Figures

LATCH ASSEMBLY FOR VENT WINDOWS AND THE LIKE

BACKGROUND OF THE DISCLOSURE

1. Field of the Invention.

This invention relates to toggle catches used for opening vent windows in motor vehicle and the like; more particularly, to a toggle catch that has an anti-theft latch device.

2. Description of the Prior Art.

Many motor vehicles are now using vent-type windows rather than roll down windows. The vent type windows lighten the motor vehicle by eliminating the need for the heavy roll down mechanism. Conventionally, one edge of the window is pivotably mounted to the window frame of a vehicle while the other end of the window has a toggle catch which is movable to an open position wherein the window is pushed outwardly from the interior of the vehicle and a closed position where the window is flush with its molding. One such mechanism is disclosed in U.S. Pat. No. 3,711,893 issued to King on Jan. 23, 1973.

As with all motor vehicle, the risk of theft of the vehicle or any of its contents is significant. In order for a thief to steal a motor vehicle or any of its contents, it is usually essential for him to enter the interior of the vehicle. The thieves resort to various methods in entering the vehicle, such as sticking hangers, hooks, and burglary tools between cracks in the window; picking locks; or sticking hangers or burglary tools between cracks of the door and body to release the door catch. They also pray open vent windows to obtain access into the vehicle.

As such, certain security devices are desirable which resist a thief's efforts of prying open a vent window. U.S. Pat. No. 2,475,131 issued to Edwards et al on July 5, 1949, discloses a toggle mechanism which has a locking bolt resiliently mounted on one of the links which engages an aperture on the base portion of the toggle catch which is attached to the sill or molding about the window. The aperture is specifically shaped such that a specific instrument must be used to depress the locking bolt. Only authorized people with the specified tool can open the toggle catch.

It is desirable that a security device will resist a thief's efforts from the exterior side of the window, but at the same time allow passengers within the vehicle to conveniently open the window.

SUMMARY OF THE INVENTION

According to the invention, a toggle catch has one end mounted to one end of a pivotable vent window and its other end mounted to a molding adjacent the window for opening and closing the vent window. The toggle catch has a base section, intermediate link section, and a handle section. The base section is rigidly mounted to the molding adjacent the window. The first or intermediate link is pivotably connected at one end thereof to the base section and has its other end connected to the handle section. The handle section is pivotably connected to the vent window. The toggle catch has a closed position wherein the handle section is folded over the intermediate link and the base section.

The handle section has two opposing latches pivotably mounted thereto. The latches are spring biased to independently engage the base and to prevent the handle from being moved to the open position without manual operation of the latches to a disengaging position. Each latch has a grip portion which is manually engageable for moving the latch to the disengaging position and allowing the toggle catch to be operated and moved to an open unfolded position.

In one embodiment, a coil spring is interposed between the grip portions of the latches and outwardly biases said grip portions. Each latch also has an inwardly directed prong for engagement with an outwardly extending flange from the base section. Each latch also is pivotably connected to the base section between the grip portion and the prongs such that the outward biasing force of the spring against the grip portion inwardly biases the prongs into engagement with the flange of the base. Inward manual movement of the grip portion outwardly moves the prongs to disengage from the flange.

In one embodiment, the handle section of the toggle catch has an aperture extending between the latches with the coil spring extending through the aperture with each end of the coil spring abutting an opposing latch. Preferably, at each side of the handle section is a recess which receives the grip portions of the latches when the latches are squeezed to their disengaging position.

In one specific embodiment, the prongs extend inwardly and upwardly into a groove in an undersurface of the flange in the base. The outer edge of the groove is downwardly sloped. In addition, the upper surface of the flange in the base is curved to cam the prongs outwardly when the catch is being closed over the base.

BRIEF DESCRIPTION OF THE DRAWINGS

Reference now will be made to the following drawings in which.

DETAILED DESCRIPTION OF THE PREFERRED EMBODIMENT

Figure 1:
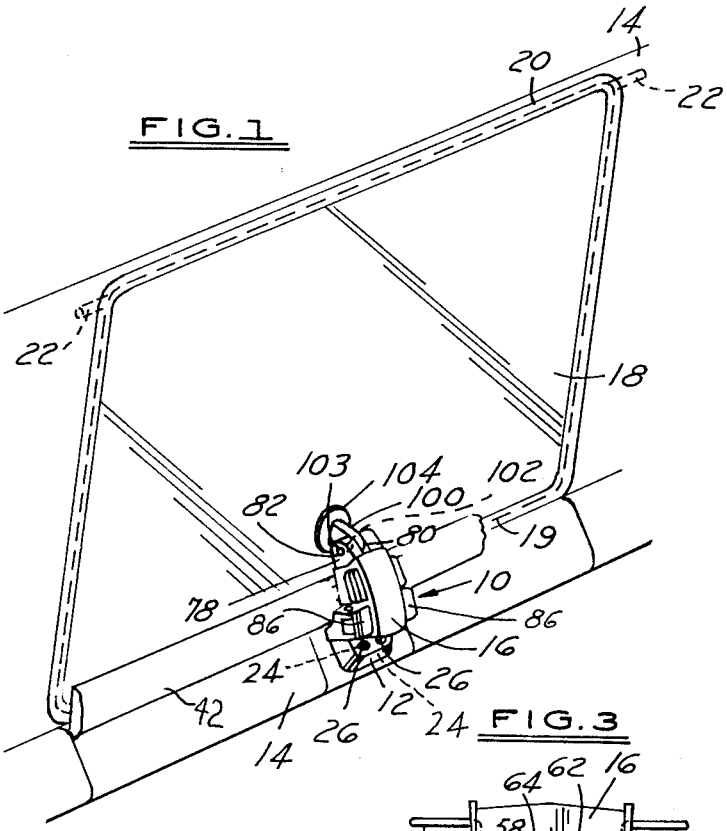
FIG. 1 is a perspective view of one embodiment of the invention in its preferred setting attached to a tempered glass window.

Referring specifically to FIG. 1, a toggle catch 10 has a base 12 mounted on a window molding 14 and a handle section 16 pivotably mounted to a window 18 near its bottom edge 19. The window 18 is pivotably mounted at an opposite end 20 to molding 14 by pivot hinges 22.

Figure 2:
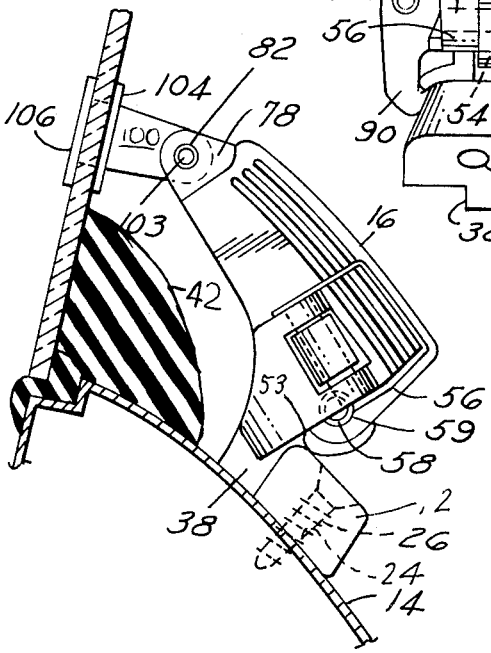
FIG. 2 is an enlarged side elevational view of the embodiment shown in FIG. 1.
Figure 4:
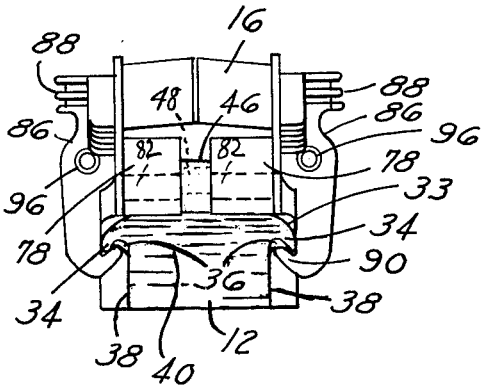
FIG. 4 is a rear elevational view thereof.
Figure 7:
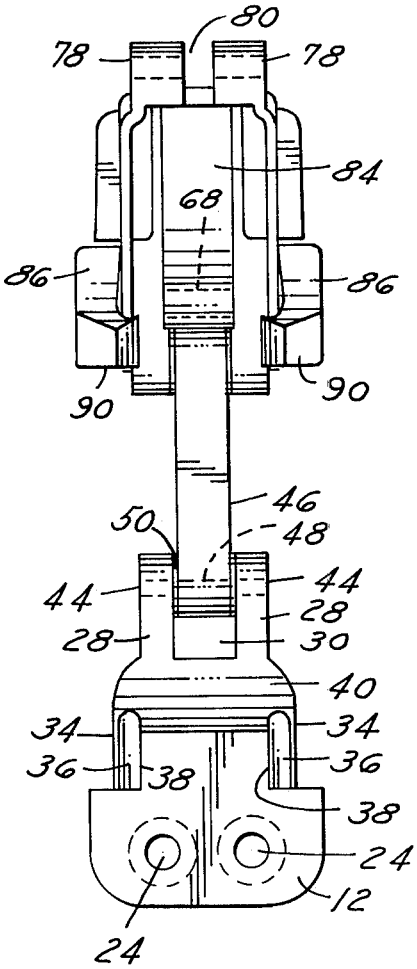
FIG. 7 is a bottom elevational view of the embodiment shown in FIG. 1 in an open position.
Figure 8:
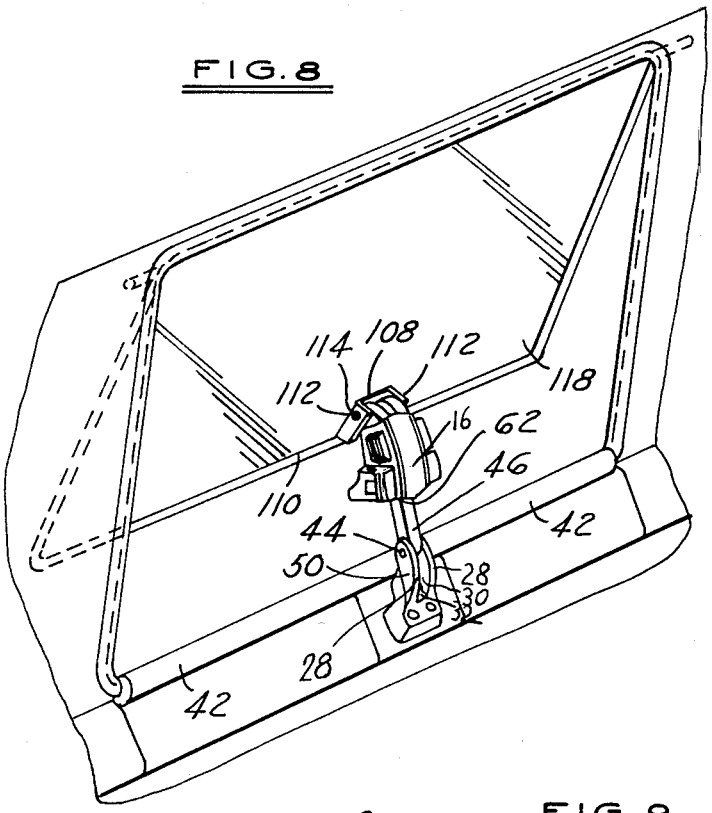
FIG. 8 is a perspective of the toggle catch in its open position and adapted to be attached to a laminated glass window.

As shown in FIGS. 1, 2 and 7, the base 12 has two apertures 24 therethrough which receive screws 26 which secure the base 12 to the molding 14. As shown in FIG. 8, the base 12 has two curved upper arms 28 with a space 30 therebetween. At the base of the arms 28, is a recess 32. Also, at the base of the arms are outwardly extending flanges 34 as shown in FIGS. 4 and 7. The top surface 33 of flanges 34 are sloped downwardly to form a camming surface. Each flange has on its underside a groove 36. The inside edge of the groove 36 is bounded by recessed shoulder 38.

The rear side 40 of base 12 is concave in shape to accommodate a convex shaped rubber seal 42 about the edge of the molding 14 which seals the molding 14 to the window 18. The top ends of the arms 28 have apertures 44 aligned with each other.

Figure 3:
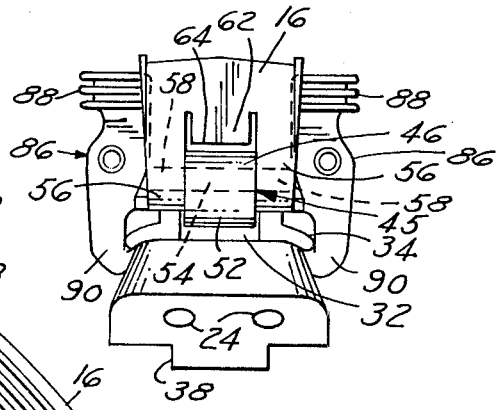
FIG. 3 is a front elevational view thereof.
Figure 9:
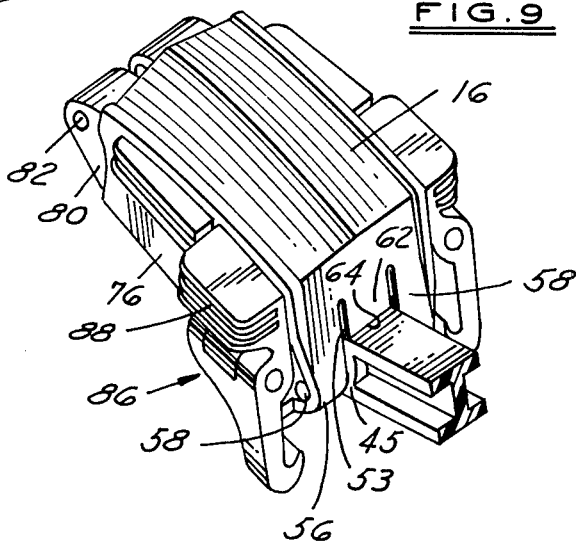
FIG. 9 is a fragmentary and enlarged view of the latch shown in FIG. 8 in the open position.

An intermediate link 46 is positioned in the space 30 between the arms 28. The intermediate link 46 has an aperture 48 at its one end which is aligned with the apertures 44. A roll pin 50 is snugly fitted therethrough to pivotably attach the intermediate link 46 to the arms 28. As shown in FIGS. 3 and 9, the other end 45 of link 46 is rounded to form a cam surface 52. The cam surface 52 has a shoulder 53 thereon. The cam surface 52, when the toggle catch is in the closed position, lies in recess 32. An aperture 54 extends through the end 45.

The handle section 16 has two downwardly extending projections 56 with apertures 58 therethrough. The intermediate link 46 is interposed between the two projections such that apertures 58 align with the aperture 54. A roll pin 59 is snugly fitted through the apertures 54 and 58 to pivotably attach the intermediate link with the handle section.

Figure 5:
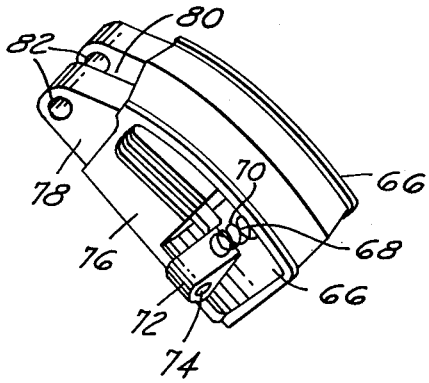
FIG. 5 is a fragmentary partially broken view of the handle section shown in FIG. 1.

As clearly shown in FIGS. 3 and 9, the handle section 16 has a resilient flap 62 extending downward between the projections 56. The flap 62 has a bottom edge 64 with a camming surface. As shown in FIG. 5, behind the flap of the handle section 16 are two opposing recesses 66 with an aperture 68 extending therebetween. A coil spring 70 fits through the aperture 68 and extends into the recesses 66. The handle section 16 has a hollow interior 84 as shown in FIG. 7.

Below the recesses 66 are outwardly extending shoulders 72 with apertures 74 extending therethrough. The handle section 16 has side walls 76 behind the shoulders 72 and a rear end 78 having a longitudinal slot 80 therethrough and lateral apertures 82 extending therethrough.

Figure 6:
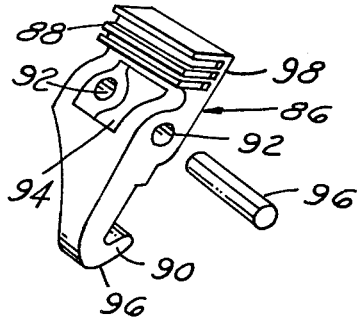
FIG. 6 is a perspective view of the latch and pin shown in FIG. 1.

Referring now to FIGS. 3, 4 and 6, two opposing latches 86 are mounted onto shoulders 72. Each latch 86 has a grip portion 88 at its top end and a prong portion 90 at its bottom end. Each prong extends inwardly and upwardly. The bottom end of the prong 90 has a camming surface 96. The grip portion has a flat solid inner side surface 98. Between the prong portion 90 and the grip portion 88 are apertures 92 and hole 94. The shoulders 72 extend through holes 94 such that apertures 92 are aligned with apertures 74. Roll pins 96 snugly fit therein to pivotably mount the latch 86 to the handle section 16. The latch 86 is mounted to the shoulder such that the coil spring 70 abuts each side surface 98 to outwardly bias the handle portion 88.

As shown in FIGS. 1 and 2, the handle section 16 is mounted to the window made from tempered glass by means of a single prong 100 extending into the slot 80. Prong 100 has an aperture 102 therethrough aligned with apertures 82. Roll pin 103 extends through the apertures 82 and 102 to pivotably connect the handle section to the prong 100. The prong 100 is rigidly connected to a plate 104, which is flush with the tempered glass window 18 and a second plate 106 which abuts the opposing side of the window 18.

FIG. 8 shows the toggle catch 10 mounted to a laminated glass window 118. A tapered prong 108 extends from the frame 110 of window 118. The prong has a pair of outwardly directed shoulders 112 each with an aperture 114 therethrough. A pivot pin 116 extends through the apertures 114 and apertures 82 of the handle section 16 to pivotably connect the handle section 16 to the window 118. This mounting is suitable for windows made of laminated glass or other plastic materials which cannot have holes drilled therethrough.

OPERATION OF THE TOGGLE CATCH

As shown in FIGS. 1, 2 and 4, when the toggle catch is in the closed position, the handle section 16 extends over the intermediate link 46 and the arms 28 of the base 12. The arms and the intermediate link 46 are received in the hollow interior 84. In addition, each latch 86 has its prong section extending downward and directly under the flange 34. In this position, the handle section 16 cannot be moved toward its open position because the prongs 90 will engage the groove 36 in flange 34, and block further movement.

However, a person can easily grasp the two grip portions 88 and squeeze them against the outwardly biasing forces exerted by the coil spring 70. The inward motion of the grip portion 88 pivots the prongs 90 outwardly to disengage from the flange 34. In this position, the person, while squeezing the grip portion 88, can upwardly move the handle section 16 toward its open position as shown in FIG. 8. The intermediate link 46 pivots with respect to both the handle section 16 and the base 12. The window 18 pivots about its hinges 22 so that the bottom edge 19 moves away from molding 14.

Both latches 86 must be operated independently and simultaneously for the catch to open. Operation of only one of the latches 86 does not effect the positive latching of the other latch 86.

When the toggle catch 10 is fully extended, the cam surface 52 passes under the flap 62. Resilient flap 62 then springs downwardly to engage the shoulder 53 as shown in FIG. 9. In this position, the toggle catch 10 is in a locked open position and resistent to the gravitational force of the window or wind which may press against the window. However, when it is desirous to close the window, the operator merely grabs the handle section and manually overcomes the retaining force of the flap 62 against the shoulder 53 such that the resilient flap bends upward against the camming surface 52 and the toggle catch is then moved to its closed folded position.

As shown in FIG. 4, when the handle section 16 folds over the base, each camming surface 96 of prong 90 abuts the camming surface 33 of the base 12 such that the latches 86 automatically pivot outwardly so that the prongs 90 can pass by flange 34 and spring back to its engaged position under groove 36.

In this fashion, a toggle catch is made which automatically closes to a locked position and can be conviently disengaged from the interior while frustrating attempts to open the window from the opposite side thereof.

Various modifications and variations are possible within the scope of the foregoing disclosure and drawings without departing from the spirit of the invention which is defined by the appended claims.

I claim:

1. In a toggle catch for a pivotable vent window having: a base rigidly mountable to a molding; an intermediate link pivotably connected at one end thereof to the base; a handle section connected at one end thereof to an opposing end of said intermediate link; said handle section being pivotably connectable to said vent window such that said catch has an open and closed position with said handle section folded over said intermediate link and base in said closed position; the improvement comprising:

two latches;

pivot means for pivotably mounting said latches to the handle section for engagement with said base when the catch is in a closed position and preventing the catch from moving to an open position;

spring means connected to said latches for biasing said latches to the engaging position;

each of said latches having a grip portion;

said grip portions being manually engageable for moving said latch to a disengaging position to release said base such that the catch is allowed to be moved to an open position.

2. A toggle catch as defined in claim 1 wherein the spring means comprises a coiled spring interposed between the two grip portions of said latches and outwardly biasing said grip portion; said latches have inwardly directed prongs for engagement with outwardly extending flanges in said base; said pivot means located between said grip portions and prongs of each latch such that the outward biasing force against the grip portions inwardly biases the prongs into engagement with said flanges; inward manual movement of said grip portions outwardly moves said prongs and disengages them from the base.

3. A toggle catch as defined in claim 2 wherein the handle section has an aperture therethrough between said grip portions and said pivot means comprises;

two outwardly, extending and opposing shoulders integral with said handle section located below said aperture;

said latches each having a hollow section for receiving said shoulder and a pin extending through aligned apertures in each latch and shoulder to pivotably mount said latches to said handle section;

said coiled spring extending through said aperture between said grip portions and abutting the inner side of said grip portions and outwardly biasing said grip portions such that said grip portions are manually squeezed together against the biasing force of said spring to release said latches from said flange of said base.

4. A toggle catch as defined in claim 3 wherein the prongs extend upwardly into a groove in the undersurface of the outwardly extending flange in said base, the outer edge of said groove being downwardly sloped; portions of an upper surface of said flange of said base has a camming surface for camming said prongs outwardly when said catch is being closed.

5. A toggle catch as defined in claim 3 and further comprising a camming surface at the end of the intermediate link where it is connected to the handle section;

the camming surface curves and ends at a downwardly extending shoulder;

said handle section has a resilient flange downwardly extending at a front surface thereof;

the resilient flange has a camming edge at its lower end;

said camming edge abuts said camming surface to resiliently move the flap over said camming surface such that when the camming surface ends, the flap resiliently snaps back such that the camming edge extends over said shoulder;

the camming edge when abutting said shoulder retains said catch in an open position;

said resilient flange resiliently bends to allow said shoulder to move under said camming edge when a sufficient manual force is applied thereto to move said toggle catch back to its closed position.

6. A toggle catch as defined in claim 3 wherein;

said handle section has an upper surface, opposing recesses in the opposite side of said handle section extend under said upper surface; said aperture receiving said coiled spring extending from one of said recesses to the opposite recess;

inner surfaces of said grip portion of the latches face the recesses with said grip portion manually pivotable into said recesses when said latches are in the disengaged position.

* * * * *